US010991539B2

(12) United States Patent
Kenmotsu et al.

(10) Patent No.: US 10,991,539 B2
(45) Date of Patent: Apr. 27, 2021

(54) X-RAY TUBE AND A CONDITIONING METHOD THEREOF

(71) Applicant: Nanox Imaging PLC, Gibraltar (GI)

(72) Inventors: Hidenori Kenmotsu, Tokyo (JP); Hitoshi Masuya, Chiba (JP); Koichi Iida, Hokkaido (JP)

(73) Assignee: NANO-X IMAGING LTD., Neve-Ilan (IL)

( * ) Notice: Subject to any disclaimer, the term of this patent is extended or adjusted under 35 U.S.C. 154(b) by 90 days.

(21) Appl. No.: 15/472,656

(22) Filed: Mar. 29, 2017

(65) Prior Publication Data

US 2017/0301505 A1 Oct. 19, 2017

Related U.S. Application Data

(60) Provisional application No. 62/316,406, filed on Mar. 31, 2016.

(51) Int. Cl.

| | |
|---|---|
| ***H01J 35/02*** | (2006.01) |
| ***H01J 35/04*** | (2006.01) |
| ***H01J 35/06*** | (2006.01) |
| ***H01J 35/08*** | (2006.01) |
| ***H01J 35/14*** | (2006.01) |

(Continued)

(52) U.S. Cl.

CPC ..... *H01J 35/153* (2019.05); *H01J 9/39* (2013.01); *H01J 35/025* (2013.01); *H01J 35/04* (2013.01); *H01J 35/045* (2013.01); *H01J 35/06* (2013.01); *H01J 35/064* (2019.05); *H01J 35/065* (2013.01); *H01J 35/066* (2019.05); *H01J 35/08* (2013.01); *H01J 35/112* (2019.05); *H01J 35/14* (2013.01); *H01J 35/147* (2019.05); *H01J 35/20* (2013.01); *H05G 1/56* (2013.01); *G21K 1/025* (2013.01)

(58) Field of Classification Search

CPC ..... H01J 35/04; H01J 35/045; H01J 35/06; H01J 35/065; H01J 35/08; H01J 35/10; H01J 35/14; H01J 35/025; H01J 35/064; H01J 35/066; H01J 35/112; H01J 35/116; H01J 35/147; H01J 35/153; H01J 35/02

USPC ..... 378/122, 134, 121, 136–138

See application file for complete search history.

(56) References Cited

U.S. PATENT DOCUMENTS 6,553,096 B1 * 4/2003 Zhou ..... A61B 6/4028 378/122

6,556,656 B2 * 4/2003 Hess ..... H01J 35/06 378/136

(Continued)

*Primary Examiner* — Allen C. Ho

(74) *Attorney, Agent, or Firm* — Alphapatent Associates, Ltd; Daniel J. Swirsky

(57) ABSTRACT

The X-ray tube disclosed herein includes an electron emission unit including an electron emission element using a cold cathode; an anode unit disposed opposite to the electron emission unit, with which electrons emitted from the electron emission unit collide; and a focus structure disposed between the electron emission unit and a target unit disposed on a surface of the anode unit that is opposed to the electron emission unit. The electron emission unit is divided into a first region and a second region which can independently be turned ON/OFF. The X-ray tube is focus-designed such that collision regions, at the anode unit, of electron beams emitted from the respective first region and second region substantially coincide with each other.

3 Claims, 1 Drawing Sheet

(51) Int. Cl.

| | |
|---|---|
| ***H05G 1/56*** | (2006.01) |
| ***H01J 9/39*** | (2006.01) |
| ***H01J 35/20*** | (2006.01) |
| *G21K 1/02* | (2006.01) |

(56) References Cited

U.S. PATENT DOCUMENTS 6,570,958 B2 * 5/2003 Brendler ..... H01J 35/045 378/113
6,674,837 B1 * 1/2004 Taskar ..... A61B 6/00 378/122
6,760,407 B2 * 7/2004 Price ..... H01J 35/065 378/119
7,082,182 B2 * 7/2006 Zhou ..... A61B 6/032 378/10
7,085,352 B2 * 8/2006 Dunham ..... A61B 6/032 313/373
7,192,031 B2 * 3/2007 Dunham ..... A61B 6/032 378/122
7,245,692 B2 * 7/2007 Lu ..... G01N 23/04 378/4
7,388,944 B2 * 6/2008 Hempel ..... H01J 3/00 378/122
7,627,087 B2 * 12/2009 Zou ..... H01J 1/304 378/122
7,715,529 B1 * 5/2010 Lee ..... H01J 35/08 378/124
7,778,391 B2 8/2010 Fuerst et al.
7,801,277 B2 * 9/2010 Zou ..... H01J 35/065 378/119
7,809,114 B2 * 10/2010 Zou ..... H01J 1/3048 378/122
7,826,594 B2 * 11/2010 Zou ..... H01J 1/30 378/10
7,826,595 B2 * 11/2010 Liu ..... H01J 35/14 378/122
7,873,146 B2 * 1/2011 Okunuki ..... H01J 35/065 378/122
7,991,114 B2 * 8/2011 Okunuki ..... A61B 6/032 378/11
7,991,120 B2 * 8/2011 Okunuki ..... A61B 6/00 378/122
8,026,674 B2 * 9/2011 Berk ..... H05G 1/46 313/309
8,155,273 B2 * 4/2012 Eaton ..... H01J 35/065 378/122
8,189,893 B2 * 5/2012 Zhang ..... A61B 6/032 382/131
8,199,881 B2 * 6/2012 Kim ..... H01J 35/065 378/119
8,300,769 B2 * 10/2012 Kim ..... H01J 35/065 378/122
8,374,315 B2 * 2/2013 Freudenberger ..... H01J 35/14 378/134
8,385,506 B2 * 2/2013 Lemaitre ..... H01J 1/20 378/136
8,447,013 B2 * 5/2013 Sprenger ..... H01J 35/04 378/122
8,488,742 B2 * 7/2013 Tsujii ..... A61B 6/4441 378/138
8,509,387 B2 * 8/2013 Tsujii ..... A61B 6/06 378/122
8,588,372 B2 * 11/2013 Zou ..... H01J 35/065 378/113
8,699,657 B2 * 4/2014 Baeumer ..... A61B 6/032 250/494.1
8,750,458 B1 * 6/2014 Wang ..... H01J 3/023 378/122
8,761,343 B2 * 6/2014 Jeong ..... H01J 35/065 378/121
8,761,344 B2 * 6/2014 Reynolds ..... H01J 35/14 378/136
8,774,364 B2 * 7/2014 Aoki ..... H05G 1/12 378/104
8,804,910 B1 * 8/2014 Wang ..... H01J 35/16 378/101
8,831,178 B2 * 9/2014 Lemaitre ..... H01J 35/06 378/136
8,837,678 B2 * 9/2014 Turqueti ..... H01J 35/065 378/124
8,897,419 B1 * 11/2014 Jacob ..... H01J 35/04 378/126
8,989,351 B2 * 3/2015 Vogtmeier ..... H01J 35/06 378/122
9,048,064 B2 * 6/2015 Boye ..... H01J 35/14
9,053,890 B2 * 6/2015 Sun ..... H01J 1/304
9,093,245 B2 * 7/2015 Morton ..... H01J 35/06
9,099,280 B2 * 8/2015 Jeong ..... H01J 35/14
9,105,437 B2 * 8/2015 Choi ..... H01J 35/065
9,390,880 B2 * 7/2016 Jeong ..... H01J 35/065
9,941,091 B2 * 4/2018 Jeong ..... H01J 35/065
10,068,740 B2 * 9/2018 Gupta ..... H01J 35/025
10,217,598 B2 * 2/2019 Evans ..... H01J 35/30
10,269,527 B2 * 4/2019 Kenmotsu ..... H01J 35/065
10,334,712 B2 * 6/2019 Jeong ..... A61B 6/00
10,438,765 B2 * 10/2019 Jeong ..... H01J 35/045

* cited by examiner

FIG.1
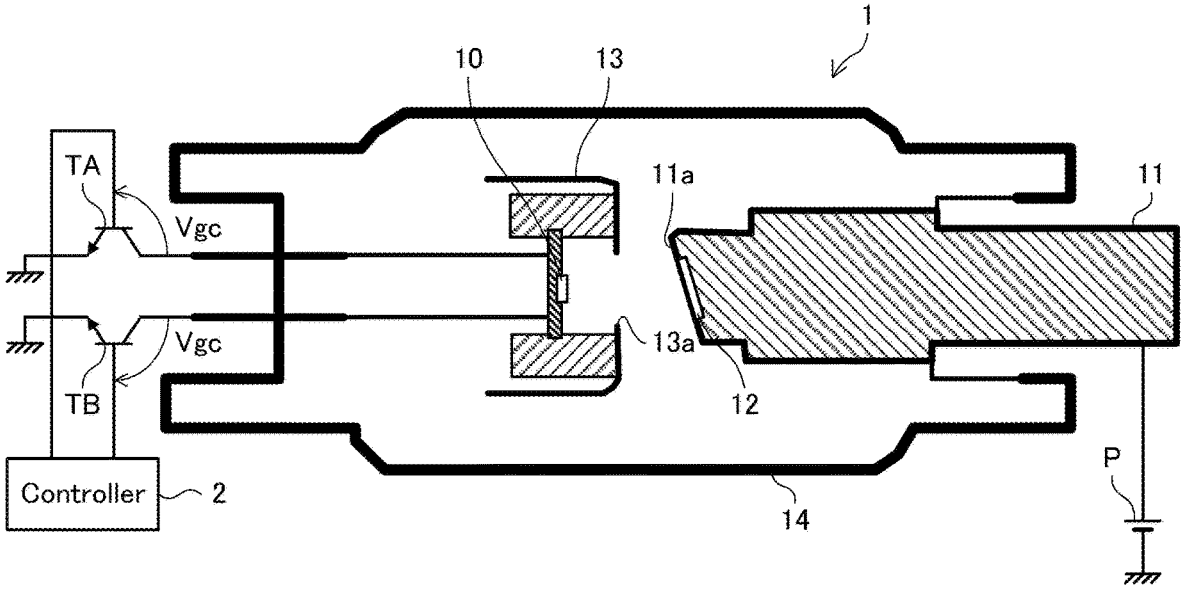
FIG.2
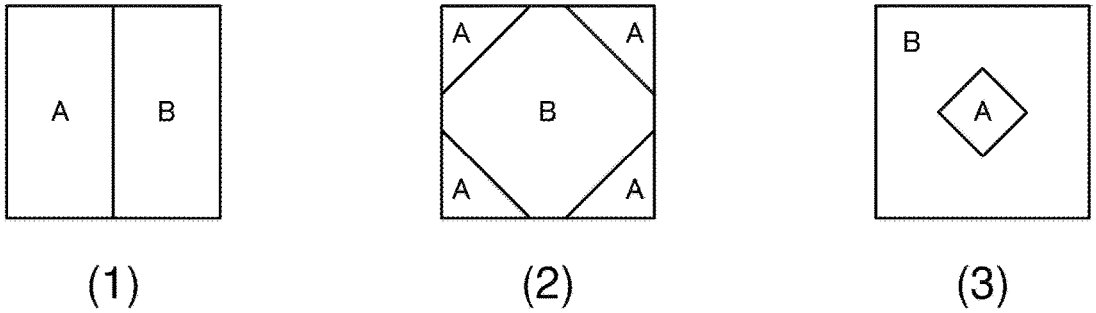
FIG.3
| Drive state | | Region A | Region B |
|---|---|---|---|
| 1 | Conditioning | Emitter On (Vgc 30～40V) | Emitter Off (Vgc 0～10V) |
| 2 | Actual operation | Emitter Off (Vgc 0～10V) | Emitter On (Vgc 30～40V) |

X-RAY TUBE AND A CONDITIONING METHOD THEREOF

BACKGROUND OF THE INVENTION

Field of the Invention

The present invention relates to an X-ray tube and a conditioning method therefor.

Description of Related Art

Conventional X-ray tubes use a filament as a cathode and uses thermoelectrons emitted from the filament as an electron source. On the other hand, there are proposed some X-ray tubes that use a cold cathode source as an electron emission element. Such an X-ray tube is disclosed in, e.g., U.S. Pat. Nos. 7,778,391, 7,809,114, and 7,826,595.

SUMMARY

However, when a cold cathode source is used as an electron emission source, there is a problem that electron emission is easily affected by the degree of vacuum of an X-ray tube during its operation because the electron emission is sensitive to a surface state of the cathode compared to a hot cathode. Particularly, it is known that in a Spindt-type cold cathode array using a molybdenum (Mo) material, a current decrease occurs due to generation of oxidizing gas in a vacuum tube being in an operating state (see J. Vac. Sci. Technol. B16, 2859 (1998), Effect of O2 on the electron emission characteristics of active molybdenum field emission cathode arrays (B. Chalamala, et al)). Thus, for some situations, there is a problem that decrease in anode current occurs by that the operation of the X-ray tube is conducted continuously.

In order to prevent such a problem, a method of gradually increasing extraction voltage is also adopted (see IVNC2013 P15, Stable, High Current Density Carbon Nanotube Field Emission Devices (D. Smith et al), Proc Of SPIE Vol. 7622 76225M-1, Distributed Source X-ray technology for Tomosynthesis imaging (F. Sprender, et al)); in this case, however, a problem such as discharge may occur when the extraction voltage exceeds a predetermined value.

The object of the present invention is to provide an X-ray tube and a conditioning method therefor capable of avoiding the above problems.

An X-ray tube according to the present invention includes: an electron emission unit including an electron emission element using a cold cathode; an anode unit disposed opposite to the electron emission unit, with which electrons emitted from the electron emission unit collide; and a focus structure disposed between the electron emission unit and a target unit disposed on a surface of the anode unit that is opposed to the electron emission unit. The electron emission unit is divided into first and second regions which can independently be turned ON/OFF. The X-ray tube is focus-designed such that collision regions of electron beams emitted from the respective first and second regions substantially coincide with each other.

A conditioning method according to the present invention is a conditioning method for an X-ray tube. The X-ray tube includes: an electron emission unit including an electron emission element using a cold cathode; an anode unit disposed opposite to the electron emission unit, with which electrons emitted from the electron emission unit collide; and a focus structure disposed between the electron emission unit and a target unit disposed on an opposing surface of the anode unit to the electron emission unit. The electron emission unit is divided into first and second regions which can independently be turned ON/OFF. The X-ray tube is focus-designed such that collision regions, at the anode unit, of electron beams emitted from the respective first and second regions substantially coincide with each other. In the conditioning method, one of the first and second regions is used for conditioning and other one of them for actual operation.

BRIEF DESCRIPTION OF THE DRAWINGS

The above features and advantages of the present invention will be more apparent from the following description of certain preferred embodiments taken in conjunction with the accompanying drawings, in which:

FIG. 1 is a cross-sectional view schematically illustrating an X-ray tube 1 according to an embodiment of the present invention;

FIG. 2 shows three embodiments of the electron emission unit 10, each being a square electron emission unit divided into a first region A and a second region B having line symmetry to each other, wherein (1) the first region A and the second region B are rectangular regions standing side by side;

(2) is a square electron emission unit formed in a square shape divided into a center region B having a square shape that is inclined at 45 to the emission unit, and a peripheral region A comprising the four corners of the electron emission unit surrounding the center region B, and (3) is a square electron emission unit formed in a square shape divided into a center region A having a square shape that is inclined at 45 to the emission unit, and a peripheral region B surrounding the center region A on all sides; and FIG. 3 is a view explaining the drive state of the X-ray tube 1 according to an embodiment of the present invention.

DETAILED DESCRIPTION OF THE EMBODIMENTS

Preferred embodiments of the present invention will be explained below in detail with reference to the accompanying drawings.

The present invention controls and stabilizes a vacuum state in an X-ray tube so as to prevent current variation which occurs in the conventional cold cathode electron tubes during operation. Specifically, there is provided an emitter structure including a plurality of electron beam emission regions, and focus design is made such that an electron beam collides with the same region of the anode while independently controlling the plurality of electron beam emission regions.

This allows at least one first electron beam emission region to be used for conditioning to make an electron beam collide with the anode, making it possible to degas the electron beam collision region. At this time, a fixed potential is applied between the gate and the cathode of the second electron beam emission region not used for conditioning so as to turn OFF the second electron beam emission region. The emitter in an OFF state is inactive, so that even when degassing occurs during conditioning, there is a low probability that the surface condition of the emitter varies. After the surface of the anode is sufficiently degassed by conditioning, the second electron beam emission unit which is turned OFF during conditioning is used for actual operation.

By making a focus design such that collision regions, at the anode, of the electron beams emitted from the respective first and second electron beam emission regions substantially coincide with each other, it is possible to suppress degassing during actual operation, thereby obtaining stable operation.

Hereinafter, first and second embodiments of the present invention will be described successively.

FIRST EMBODIMENT

FIG. 1 is a cross-sectional view schematically illustrating an X-ray tube 1 according to a first embodiment of the present invention. As illustrated in FIG. 1, the X-ray tube 1 has a structure in which an electron emission unit 10, an anode unit 11, a target unit 12, and a focus structure 13 are disposed in a vacuum area surrounded by a glass outer wall 14. FIG. 1 also illustrates a controller 2 for the X-ray tube 1.

The electron emission unit 10 has an electron emission element using a cold cathode and is configured to emit electrons from the cold cathode. While details will be described later, the electron emission unit 10 is divided into two regions A and B (first and second regions). The regions A and B are grounded through transistors TA and TB, respectively.

The anode unit 11 is disposed opposite to the electron emission unit 10 and connected to a power supply P. Thus, when either of the transistors TA or TB is turned ON, current flows from the power supply P through the anode unit 11 and electron emission unit 10. At this time, a plurality of electrons are emitted from the electron emission unit 10. These electrons collide with the anode unit 11, pass therethrough, and is absorbed by the power supply P. As illustrated in FIG. 1, a surface 11*a* of the anode unit 11 that is opposed to the electron emission unit 10 is inclined to the electron moving direction (direction from the left to the right in FIG. 1).

The target unit 12 is a member made of a material that generates an X-ray by receiving electrons and disposed on the opposing surface 11*a*. Since the target unit 12 is disposed on the opposing surface 11*a*, some or all of the plurality of electrons that collide with the anode unit 11 pass through the target unit 12, and an X-ray is generated in the target unit 12 during the passage. The thus generated X-ray is radiated downward owing to inclination of the opposing surface 11*a*.

The focus structure 13 is a structure having a function of correcting the trajectory of the electron emitted from the electron emission unit 10 and has a window 13*a* as illustrated in FIG. 1. The electrons emitted from the electron emission unit 10 are directed to the target unit 12 through the window 13*a*. For example, the window 13*a* preferably has a circular shape.

FIG. 2(1) is a view illustrating a method of dividing the electron emission unit 10 according to the present embodiment. As illustrated, the electron emission unit 10 according to the present embodiment is divided into two regions A and B which are line-symmetrical to each other. More specifically, the electron emission unit 10 according to the present embodiment is formed into a square shape, and the region A is formed by one of the two regions equally divided by a straight line parallel to one side of the square, and the region B is formed by the other one of the two regions.

The regions A and B are connected to the controller 2 respectively through the mutually different transistors TA and TB. The controller 2 is configured to independently turn ON/OFF the transistors TA and TB by controlling the gate potentials of the respective transistors TA and TB. Thus, the regions A and B can independently be turned ON/OFF. The ON-state means that the region A or B functions as an electron emitter, that is, a state where electrons are emitted toward the anode unit 11 from the region A or B. On the other hand, the OFF-state means that the region A or B does not function as the electron emitter, that is, a state where electrons are not emitted toward the anode unit 11 from the region A or B.

The X-ray tube 1 according to the present embodiment is focus-designed such that a collision region, at the anode unit 11 (region within the opposing surface 11*a*), of the electron beam emitted from the region A illustrated in FIG. 2(1) and a collision region, at the anode unit 11 (region within the opposing surface 11*a*), of the electron beam emitted from the region B illustrated in FIG. 2(1) substantially coincide with each other. That is, the electron emission unit 10 and the focus structure 13 are configured such that a collision region, at the anode unit 11 (region within the opposing surface 11*a*), of the electron beam emitted from the region A illustrated in FIG. 2 (1) and a collision region, at the anode unit 11 (region within the opposing surface 11*a*), of the electron beam emitted from the region B illustrated in FIG. 2(1) substantially coincide with each other. Such a configuration can be achieved by disposing the electron emission unit 10 and the focus structure 13 so that the center of the window 13*a* (having a circular shape, for example) and the center of the square-shaped electron emission unit 10 coincide with each other as viewed in the electron moving direction and by controlling adequately the gate-cathode voltage Vgc (i.e., gate-collector voltage of the respective transistors TA and TB) of the respective regions A and B. The X-ray tube 1 "focus-designed such that the two collision regions substantially coincide with each other" includes one in which the two collision regions do not coincide with each other within the range where the effect of the present invention can be obtained.

FIG. 3 is a view explaining the drive state of the X-ray tube 1. As illustrated, the controller 2 performs different controls between during conditioning and during actual operation. Specifically, during conditioning, the controller 2 applies a voltage Vgc of 30 V to 40 V between the gate and the cathode of the region A (i.e., between the gate and the collector of the transistor TA) to turn ON the region A as the emitter of the electrons, while applying a voltage Vgc of 0 V to 10 V (a specific potential in an non-operating state) between the gate and the cathode of the region B (i.e., between gate and collector of the transistor TB) to turn OFF the region B as the emitter of the electrons. As a result, no electron is emitted from the region B, and only electrons emitted from the region A collide with the target unit 12.

On the other hand, during actual operation, the controller 2 applies a voltage Vgc of 30 V to 40 V between the gate and the cathode of the region B (i.e., between the gate and the collector of the transistor TB) to turn ON the region B as the emitter of the electrons, while applying a voltage Vgc of 0 V to 10 V (a specific potential in an non-operating state) between the gate and the cathode of the region A (i.e., between the gate and the collector of the transistor TA) to turn OFF the region A as the emitter of the electrons. As a result, no electron is emitted from the region A, and only electrons emitted from the region B collide with the target unit 12.

According to the above control method (conditioning method), the electron beam collision regions during conditioning and during actual operation substantially coincide with each other, allowing reduction in degassing amount during actual operation, which in turn reduce current variation in the region B during actual operation. Further, it is possible to reduce a possibility of causing problems due to abnormal discharge or the like during operation.

As described above, according to the present embodiment, degassing from the electron beam collision region on the anode unit 11 of the X-ray tube 1 is suppressed to prevent current from varying even in long time operation, thereby allowing stable operation of the X-ray tube 1. Further, it is possible to reduce a probability of causing problems due to the degassing, such as abnormal discharge, allowing the service life of the X-ray tube 1 to be prolonged.

SECOND EMBODIMENT

Next, the second embodiment of the present invention will be described. The second embodiment differs from the first embodiment in the dividing method of the electron emission unit 10. Other configurations are the same as those in the first embodiment. Hereinafter, a description will be given focusing on differences from the first embodiment with the same reference numerals given to the same elements as in the first embodiment.

FIG. 2(2) is a view illustrating the dividing method of the electron emission unit 10 according to the present embodiment. As illustrated, the electron emission unit 10 according to the present embodiment is divided into two or more regions including a center region B and one or more peripheral regions A surrounding the center region B. Specifically, the electron emission unit 10 is formed into a square shape as in the first embodiment, and the region obtained by concentrically overlapping another square having a site slightly smaller than the square of the electron emission unit 10 and having an inclination of 45° with respect thereto is defined as the center region B. Further, each of four regions obtained by removing the center region B from the square-shaped electron emission unit 10 is defined as the peripheral region A. The peripheral region A according to the present embodiment corresponds to each of the peripheral regions A, and the center region B corresponds to the center region B.

The X-ray tube 1 according to the present embodiment is focus-designed such that a collision region, at the anode unit 11 (region within the opposing surface 11*a*), of the electron beam emitted from the peripheral region A illustrated in FIG. 2(2) and a collision region, the anode unit 11 (region within the opposing surface 11*a*), of the electron beam emitted from the center region B illustrated in FIG. 2(2) substantially coincide with each other. That is, the electron emission unit 10 and the focus structure 13 are configured such that a collision region, at the anode unit 11 (region within the opposing surface 11*a*), of the electron beam emitted from the peripheral region A illustrated in FIG. 2(2) and a collision region, at the anode unit 11 (region within the opposing surface 11*a*), of the electron beam emitted from the center region B illustrated in FIG. 2(2) substantially coincide with each other. Such a configuration can be achieved by disposing the electron emission unit 10 and the focus structure 13 so that the center of the window 13*a* (having a circular shape, for example) and the center of the square-shaped electron emission unit 10 coincide with each other as viewed in the electron moving direction and by controlling adequately the gate-cathode voltage Vgc (i.e., gate-collector voltage of the respective transistors TA and TB) of the respective region A and region B. In the present embodiment as well, the X-ray tube 1 "focus-designed such that the two collision regions substantially coincide with each other" includes one in which the two collision regions do not coincide with each other within the range where the effect of the present invention can be obtained.

The operation of the controller 2 in the present embodiment may be the same as the operation described in the first embodiment. That is, when the controller 2 executes the operation described in the first embodiment, the same effects as in the first embodiment can be obtained in the present embodiment. That is, degassing from the electron beam collision region on the anode unit 11 of the X-ray tube 1 is suppressed to prevent current from varying even in long time operation, thereby allowing stable operation of the X-ray tube 1. Further, it is possible to reduce a probability of occurrence of problems due to the degassing, such as abnormal discharge, allowing the service life of the X-ray tube 1 to be prolonged.

While the preferred embodiments of the present invention have been described, the present invention is not limited to the above embodiments but may be variously modified within the scope thereof.

For example, the specific dividing method of the electron emission unit 10 is not limited to those described in the first and second embodiments. FIG. 2(3) is a view illustrating another example of the dividing method of the electron emission unit 10. The example of FIG. 2(3) is basically the same as that illustrated in FIG. 2(2) but differs therefrom in that the center region A is smaller than that in the example of FIG. 2(2), and that the peripheral region B is a single region. Even in this example, by focus-designing the X-ray tube 1 such that a collision region, at the anode unit 11, of the electron beam emitted from the center region A and a collision region, at the anode unit 11, of the electron beam emitted from the peripheral region B substantially coincide with each other, it is possible to obtain the same effects as in the first and second embodiments.

Although the areas of the regions A and B are not particularly mentioned in the second embodiment, the electron emission unit 10 may be divided so that the area of the region A (e.g., total area of one or more peripheral regions) and the area of the region B (e.g., the area of the center region) are substantially equal to each other. By doing this, current of the same amount as that during actual operation can be conveniently taken during the conditioning. Further, compatibility exists between the regions A and B, thus improving usability of the X-ray tube 1.

What is claimed is:

1. An X-ray tube comprising:

an electron emission unit comprising a cold cathode, wherein the electron emission unit is divided into a first region A and a second region B, and wherein the electron emission unit is formed in a square shape, and the first region A comprises a square in a center of the electron emission unit that it inclined at 45 degrees to edges of the emission unit, and the second region B comprises four corners of the electron emission unit surrounding the first region A;

an anode unit comprising a target unit disposed opposite to the electron emission unit, with which electrons emitted from the electron emission unit collide;

a focus structure disposed between the electron emission unit and the target unit disposed on a surface of the anode unit that is opposed to the electron emission unit;

a first transistor TA connected to the first region A;

a second transistor TB connected to the second region B; and a controller configured to turn ON/OFF the first region A and the second region B independently by selectively maintaining ON and OFF gate-cathode potentials in the first transistor TA and the second transistor TB respectively, and wherein collision regions at the anode unit of electron beams emitted from the first region A and the second region B substantially coincide with each other.

2. The X-ray tube according to claim 1, wherein the first region A comprises a center region, and the second region B comprises one or more peripheral regions surrounding the center region.

3. The X-ray tube according to claim 2, wherein an area of the center region and a total area of the one or more peripheral regions are substantially equal to each other.

* * * * *